US012643699B2

(12) United States Patent
Dwyer et al.

(10) Patent No.: US 12,643,699 B2
(45) Date of Patent: Jun. 2, 2026

(54) PACKING ROBOT

(71) Applicant: Robotics Plus Limited, Tauranga (NZ)

(72) Inventors: Luke Dwyer, Tauranga (NZ); Florian Thomas Roeske, Tauranga (NZ)

(73) Assignee: Robotics Plus Limited, Tauranga (NZ)

( * ) Notice: Subject to any disclaimer, the term of this patent is extended or adjusted under 35 U.S.C. 154(b) by 1003 days.

(21) Appl. No.: 17/832,817

(22) Filed: Jun. 6, 2022

(65) Prior Publication Data

US 2022/0297863 A1 Sep. 22, 2022

Related U.S. Application Data

(63) Continuation of application No. PCT/IB2020/061569, filed on Dec. 7, 2020.

(51) Int. Cl.
*B65B 5/08* (2006.01)
*B65B 25/04* (2006.01)
*B65B 35/38* (2006.01)

(52) U.S. Cl.
CPC ..... *B65B 35/38* (2013.01); *B65B 5/08* (2013.01); *B65B 25/04* (2013.01)

(58) Field of Classification Search
CPC ..... B65B 5/08; B65B 25/04; B65B 65/006; B65B 35/38; B25J 15/0061; B25J 9/026; B25J 11/0045
See application file for complete search history.

(56) References Cited

U.S. PATENT DOCUMENTS 5,102,283 A 4/1992 Balzola Elorza
5,737,901 A 4/1998 De Greef
6,264,419 B1 * 7/2001 Schinzel ..... B25J 9/023 414/751.1
7,390,040 B2 * 6/2008 Subotincic ..... B25J 15/0616 414/737
9,776,334 B2 * 10/2017 Vangilbergen ..... B25J 15/0061
(Continued)

FOREIGN PATENT DOCUMENTS

CL 201803046 2/2019
CL 201802993 4/2019
(Continued)

OTHER PUBLICATIONS

International Search Report and Written Opinion dated Feb. 25, 2021 in connection with PCT/IB2020/061569, 10 pages.
(Continued)

*Primary Examiner* — Bradley Duckworth
(74) *Attorney, Agent, or Firm* — Baker & McKenzie LLP

(57) ABSTRACT

An improved robot for packing produce such as fruit or other produce is provided. The robot includes a plurality of longitudinal carriage arms arranged in an array, and cantilevered off a support unit such that each longitudinal carriage arm is independently movable between an extended condition and retracted condition. Each arm includes a head connected to it that is independently movable in a vertical direction to pick up, hold and/or drop off an item of produce. Each longitudinal carriage arm is further independently movable in a lateral direction to alter the relative spacing between the plurality of heads such that the heads can move across lanes of the robot. The cantilevered arrangement of each carriage arm allows for compact set-out and other advantages.

18 Claims, 10 Drawing Sheets

(56) References Cited

U.S. PATENT DOCUMENTS

| | | | | |
|---|---|---|---|---|
| 10,150,219 | B2 * | 12/2018 | Ridel | B25J 11/0045 |
| 10,458,966 | B2 * | 10/2019 | Leslie | G01N 29/04 |
| 11,034,034 | B2 * | 6/2021 | Scarfe | B25J 19/023 |

FOREIGN PATENT DOCUMENTS

| | | | |
|---|---|---|---|
| EP | 1803665 | A1 | 7/2007 |
| WO | 2008130256 | A1 | 10/2008 |
| WO | 2017182974 | A1 | 10/2017 |

OTHER PUBLICATIONS

A Chilean Office Action issued by the Chile Patent Office on Oct. 3, 2023 in connection with Chilean Patent Application No. 202201487.
A Chilean Office Action issued by the Chile Patent Office on Oct. 16, 2024 in connection with Chilean Patent Application No. 202201487, 24 pages.
An Office Action issued by the Indian Patent Office relating to Indian Patent Application No. 202217038744 dated Feb. 3, 2025, 7 pages.
An Office Action issued by the Chilean Patent Office relating to Chilean Patent Application No. 2022-01487 dated May 6, 2025, 6 pages.

* cited by examiner

PACKING ROBOT

CROSS-REFERENCE TO RELATED APPLICATIONS

This application is a continuation of and claims priority to PCT Application No. PCT/IB2020/061569 filed Dec. 7, 2020, which claims priority to New Zealand Application No. 759931 filed Dec. 6, 2019. The contents from the above are hereby incorporated in their entirety by reference.

FIELD OF THE INVENTION

The present invention relates generally to an improved robot for packing produce.

BACKGROUND OF THE INVENTION

Traditional packhouses for packing produce benefit from having a significant amount of automation, yet there is still a lot of manual, labour-intensive processes which increases production costs. The work of packing produce tends to be repetitive in nature and may place the staff packing the produce in close proximity to dangerous machinery. Increasing the amount of packhouse automation provides advantages such as: reducing packing costs, increases safety by removing staff from proximity to the machinery, increases in the speed of packing and increases in the throughput of produce, as packing which is automated may operate continuously. Providing a packing robot which can efficiently pack produce will be desirable.

Packing robots generally require regularly maintenance. However, packing robots commonly involves complex machinery that are difficult to service. It may therefore be desirable to provide a packing robot which has improved serviceability.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

It is an object of the present invention to provide an improved packing robot, which overcomes or at least partially ameliorates some of the abovementioned disadvantages or which at least provides the public with a useful choice.

SUMMARY

According to one aspect of the subject matter described in this disclosure, a robot for packing produce having a longitudinal axis, a vertical axis and a lateral axis, the robot including a plurality of longitudinal carriage arms arranged in an array, each longitudinal carriage arm independently movable between an extended condition and retracted condition in a longitudinal direction. The robot may include a plurality of heads, each head connected to a longitudinal carriage arm and independently movable in a vertical direction to pick up, hold and drop off an item of produce. The robot may include a fixed support unit for supporting the plurality of longitudinal carriage arms. The head and longitudinal carriage arm lie within a generally rectangular envelope in plan view, the rectangular envelope may be substantially as wide as the longitudinal carriage arm. Each longitudinal carriage arm may be cantilevered off the fixed support unit; and wherein each longitudinal carriage arm may be independently movable in a lateral direction to adjust relative spacing between the plurality of heads such that the heads can move across lanes of the robot.

A method of packing produce utilizing a robot may include (a) picking up at least one item of produce with at least one of a plurality of heads connected to a longitudinal carriage arm of the robot. The method may include dropping off the item of produce. The robot may include a plurality of longitudinal carriage arms arranged in an array, each longitudinal carriage arm independently movable between an extended condition and retracted condition in the longitudinal direction. The robot may include the plurality of heads, each head connected to the longitudinal carriage arm and independently movable in the vertical direction to pick up, hold and drop off the item of produce. The robot may include a fixed support unit for supporting the plurality of longitudinal carriage arms; wherein the head and longitudinal carriage arm lie within a generally rectangular envelope in plan view, the rectangular envelope may be substantially as wide as the longitudinal carriage arm; and wherein each longitudinal carriage arm may be cantilevered off the fixed support unit; and wherein each longitudinal carriage arm may be independently movable in the lateral direction to adjust relative spacing between the plurality of heads such that the heads can move across lanes of the robot.

In some embodiments, each head may be aligned longitudinally with the longitudinal carriage arm it may be connected to. Each head may be also able to rotate produce about a vertical axis. Each head may be substantially as wide as the longitudinal carriage arm it may be connected to. Each head may be connected at or towards a front end of the longitudinal carriage arm. The longitudinal carriage arm may be elongate. A width of the rectangular envelope may be approximately 40 to 150 mm wide. A width of the rectangular envelope may be approximately 50 to 80 mm wide. The head and the longitudinal carriage arm it may be connected to are generally aligned on a vertical plane. The plurality of longitudinal carriage arms are mounted below the fixed support unit. The plurality of heads can move laterally towards each other to achieve a minimal spacing of less than 80 mm between the central axis of the heads. The plurality of heads can move laterally towards each other to achieve a minimal spacing of less than 110 mm between the central axis of the heads. Each head further includes a suction cup at a distal end of the rod for holding the item of produce. The produce may include apples, avocados, and stone fruit. The robot may be a double produce packer having two adjacent stations. Each station may include a plurality of longitudinal carriage arms, a plurality of heads for picking up produce, and a fixed support unit, as claimed in any one of the previous claims; and the fixed support unit includes two lateral rails being in a direction orthogonal to the longitudinal carriage arms, each longitudinal carriage arm slidably mounted to the two lateral rails to move in the lateral direction.

The robot may include a longitudinal drive module for each longitudinal carriage arm to drive movement in the longitudinal direction. The longitudinal drive module may be not substantially wider than a width of the longitudinal carriage arm. The longitudinal drive module may be less wide than the width of the longitudinal carriage arm. The longitudinal drive module may be elongate and aligned longitudinally with the longitudinal carriage arm it drives. The longitudinal drive module and the carriage arm it may be connected to are generally aligned on a vertical plane. The longitudinal drive module lies within the generally rectangular envelope in plan view. The robot may include an energy chain connected to the longitudinal drive module, wherein the energy chain may be substantially as wide as the longitudinal carriage arm it drives. In some embodiments, at least one of: the energy chain and/or services are aligned longitudinally with the longitudinal carriage arm it drives, the energy chain and/or services and the carriage arm it may be connected to are generally aligned on a vertical plane, the energy chain and/or services lie within the generally rectangular envelope in plan view; and the energy chain and/or services lie within the generally rectangular envelope in plan view.

The robot may include a lateral drive module for each longitudinal carriage arm to drive movement in the lateral direction relative to the fixed support unit. In some embodiments, at least one of: the lateral drive module may be not substantially wider than the width of the longitudinal carriage arm; the lateral drive module may be less wide than the width of the longitudinal carriage arm; the lateral drive module may be elongate and aligned longitudinally with the longitudinal carriage arm it drives, the lateral drive module and the carriage arm it may be connected to are generally aligned on a vertical plane, the lateral drive module lies within the generally rectangular envelope in plan view, the longitudinal and lateral drive modules are mounted onto the carriage arm it drives, and each longitudinal carriage arm may be mounted to the fixed support unit at or towards a back end of the longitudinal carriage arm in the extended condition. The robot may include a front access door.

According to some embodiments, at least one of: the front access door may be movable between a closed door position and an open door position, wherein each lane of the robot can be serviced from a front when the door may be in the open door position; and the front access door may be vertically slidable between a lowered door position and a raised door position, wherein each lane of the robot can be serviced from the front when the door may be in the raised door position. The lateral drive module drives a rack and pinion mechanism to move each longitudinal carriage arm in the lateral direction. The rack may be fixed to the fixed support unit and each longitudinal carriage arm includes a pinion that engages and moves along the rack. The robot may a vertical drive module to move the head between a raised head position and a lowered head position, the vertical drive module being fixed to the head.

In some embodiments, at least one of: the vertical drive module may be housed within a housing unit of the head; and each head includes a rod movable between the raised head position and lowered head position to pick up and drop off produce. The robot may include a controller to control the movement of the robot. The robot according to claim 1, wherein each of the longitudinal carriage arms extends and retracts in the longitudinal direction between an array of pick up locations and an array of drop off locations for the produce. In some embodiments, at least one of: the drop off locations are located on trays or boxes, or punnets, or bags, the number of heads may be less than the number of pickup locations for the produce, the number of heads may be less than the number of drop off locations for the produce, and the number of pick up locations may be greater than the number of drop off locations.

BRIEF DESCRIPTION OF THE INVENTION

According to a first aspect the invention broadly comprises a robot for packing produce having a longitudinal axis, a vertical axis and a lateral axis, the robot comprising:

a plurality of longitudinal carriage arms arranged in an array, each longitudinal carriage arm independently movable between an extended condition and retracted condition in the longitudinal direction;

a plurality of heads, each head connected to a longitudinal carriage arm and independently movable in the vertical direction to pick up, hold and drop off an item of produce; and a fixed support unit for supporting the plurality of longitudinal carriage arms; and wherein each longitudinal carriage arm is cantilevered off the fixed support unit; and wherein each longitudinal carriage arm is independently movable in the lateral direction to adjust relative spacing between the plurality of heads such that the heads can move across lanes of the robot.

According to another aspect each head is aligned longitudinally with the longitudinal carriage arm it is connected to.

According to another aspect each head is aligned longitudinally with the longitudinal carriage arm it is connected to.

According to another aspect each head is substantially as wide as the longitudinal carriage arm it is connected to.

According to another aspect the head and longitudinal carriage arm lie within a generally rectangular envelope in plan view, the rectangular envelope is substantially as wide as the longitudinal carriage arm.

According to another aspect the head and the longitudinal carriage arm it is connected to are generally aligned on a vertical plane.

According to another aspect the width of the rectangular envelope is approximately 40 to 150 mm wide.

According to another aspect the width of the rectangular envelope is approximately 50 to 80 mm wide.

According to another aspect the invention further comprises a longitudinal drive module for each longitudinal carriage arm to drive movement in the longitudinal direction.

According to another aspect the longitudinal drive module is not substantially wider than the width of the longitudinal carriage arm.

According to another aspect the longitudinal drive module is less wide than the width of the longitudinal carriage arm.

According to another aspect the longitudinal drive module is elongate and aligned longitudinally with the longitudinal carriage arm it drives.

According to another aspect the longitudinal drive module and the carriage arm it is connected to are generally aligned on a vertical plane.

According to another aspect the longitudinal drive module lies within the generally rectangular envelope in plan view.

According to another aspect the invention further comprises an energy chain connected to the longitudinal drive module, the energy chain is substantially as wide as the longitudinal carriage arm it drives.

According to another aspect the energy chain and/or services are aligned longitudinally with the longitudinal carriage arm it drives.

According to another aspect the energy chain and/or services and the carriage arm it is connected to are generally aligned on a vertical plane.

According to another aspect the energy chain and/or services lie within the generally rectangular envelope in plan view.

According to another aspect the energy chain is located at or towards a back end of the longitudinal carriage arm.

According to another aspect each head is connected at or towards a front end of the longitudinal carriage arm.

According to another aspect the invention further comprises a lateral drive module for each longitudinal arm to drive movement in the lateral direction relative to the fixed support unit.

According to another aspect the lateral drive module is not substantially wider than the width of the longitudinal carriage arm.

According to another aspect the lateral drive module is less wide than the width of the longitudinal carriage arm.

According to another aspect the lateral drive module is elongate and aligned longitudinally with the longitudinal carriage arm it drives.

According to another aspect the lateral drive module and the carriage arm it is connected to are generally aligned on a vertical plane.

According to another aspect the lateral drive module lies within the generally rectangular envelope in plan view.

According to another aspect the longitudinal and lateral drive modules are mounted onto the carriage arm it drives.

According to another aspect the plurality of longitudinal carriage arms are mounted below the fixed support unit.

According to another aspect each longitudinal carriage arm is mounted to the fixed support unit at or towards a back end of the longitudinal carriage arm in the extended condition.

According to another aspect the invention further comprises a front access door.

According to another aspect the front access door is movable between a closed door position and an open door position, wherein each lane of the robot can be serviced from the front when the door is in the open door position.

According to another aspect the front access door is vertically slidable between a lowered door position and a raised door position, wherein each lane of the robot can be serviced from the front when the door is in the raised door position.

According to another aspect the fixed support unit comprises two lateral rails being in a direction orthogonal to the longitudinal carriage arms, each longitudinal carriage arm slidably mounted to the two lateral rails to move in the lateral direction.

According to another aspect the lateral drive module drives a rack and pinion mechanism to move each longitudinal carriage arm in the lateral direction.

According to another aspect the rack is fixed to the fixed support unit and each longitudinal carriage arm comprises a pinion which engages and moves along the rack.

According to another aspect the invention further comprises a vertical drive module to move the head between a raised head position and a lowered head position, the vertical drive module being fixed to the head.

According to another aspect the vertical drive module is housed within a housing unit of the head.

According to another aspect each head comprises a rod movable between the raised head position and lowered head position to pick up and drop off produce.

According to another aspect each head further comprises a suction cup at a distal end of the rod for holding the item of produce.

According to another aspect the invention further comprises a controller to control the movement of the robot.

According to another aspect the carriage arm extends and retracts in the longitudinal direction between an array of pick up locations and an array of drop off locations for the produce.

According to another aspect the drop off locations are located on trays or boxes, or punnets, or bags.

According to another aspect the number of heads is less than the number of pickup locations for the produce.

According to another aspect the number of heads is less than the number of drop off locations for the produce.

According to another aspect the number of pick up locations is greater than the number of drop off locations.

According to another aspect the plurality of heads can move laterally towards each other to achieve a minimal spacing of less than 110 mm between the central axis of the heads.

According to another aspect the plurality of heads can move laterally towards each other to achieve a minimal spacing of less than 80 mm between the central axis of the heads.

According to another aspect the produce is apples, avocadoes and/or stonefruit.

According to another aspect the robot is a double produce packer having two adjacent stations, each station comprising:

- a plurality of longitudinal carriage arms;
- a plurality of heads for picking up produce; and
- a fixed support unit, as provided in any one of the previous clauses.

According to another aspect the invention further comprises a method of packing produce utilizing the robot.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

BRIEF DESCRIPTION OF THE DRAWINGS

The invention will now be described by way of example only and with reference to the drawings in which.

DETAILED DESCRIPTION OF PREFERRED EMBODIMENTS

Figure 1:
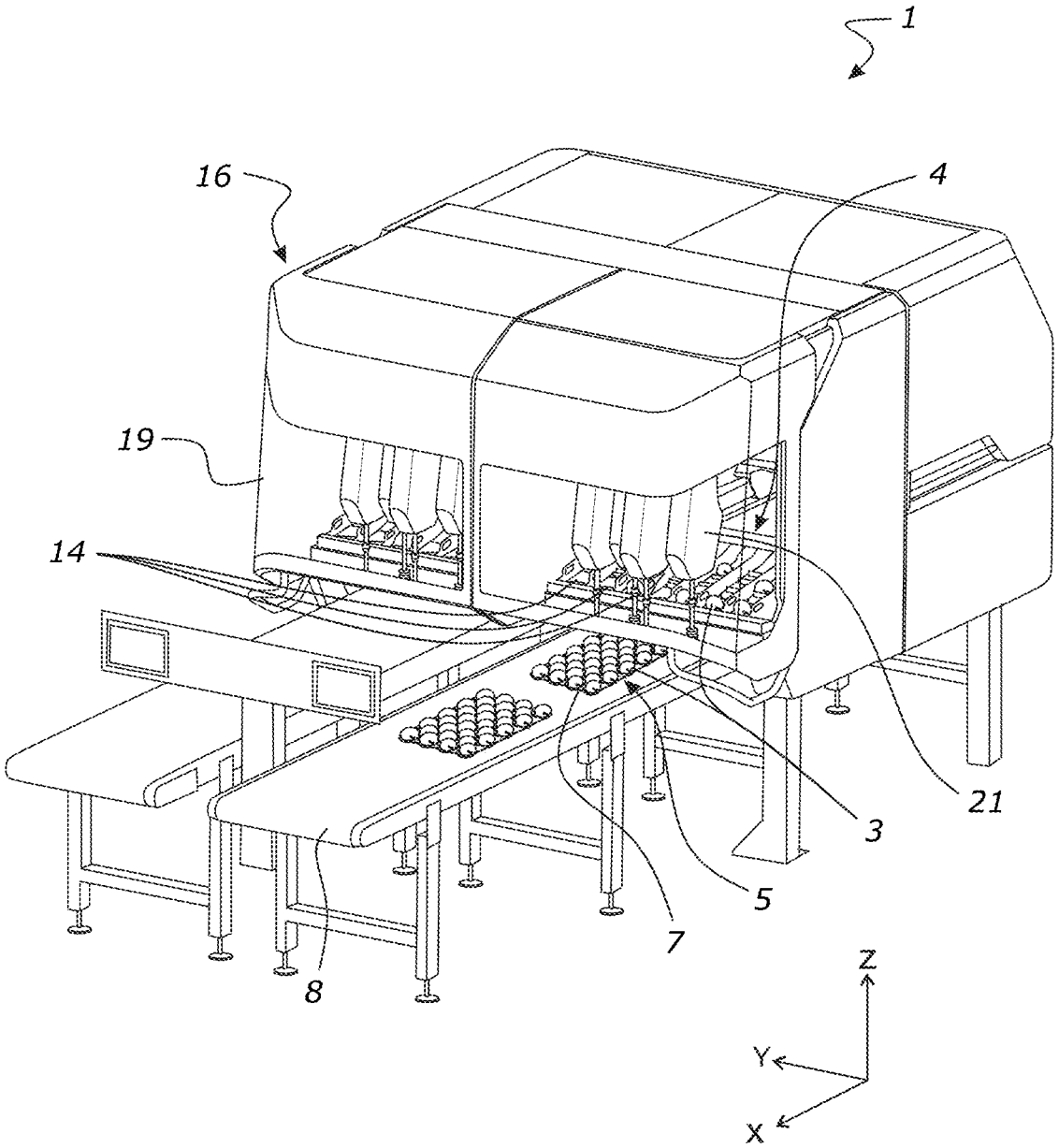
FIG. 1 shows a perspective view of a robot for packing produce including heads of a pick and place robot, front access doors, a receptacle conveyor and produce packing area with produce packed onto some receptacles.

According to various aspects of the present invention as illustrated in FIGS. 1-12, there is provided a robot 1 for packing produce which will now be described. It will be appreciated that these figures illustrate the general principles of the structure and construction, and that the invention is not limited to the precise configurations illustrated. With reference to FIG. 1, a robot 1 for packing produce 3 is shown. The robot 1 is adapted to receive produce 3 in bulk, pick the produce and pack it onto receptacles 7 for easy storage and/or transportation. Packing the produce 3 onto receptacles 7 can also minimize damage to the produce during transport.

Preferably, the produce 3 which the robot 1 packs is a type of agricultural or natural produce, such as fruits or vegetables. The produce may be any type of fruit or vegetable, specifically including but not limited to apples, pears, kiwifruit, melons, stone fruits, avocados, tomatoes and/or capsicums. In the illustrated configuration, the produce the robot 1 packs is apples. It is anticipated the robot 1 can also be used to pack other items which are not agricultural or natural produce.

Figure 2:
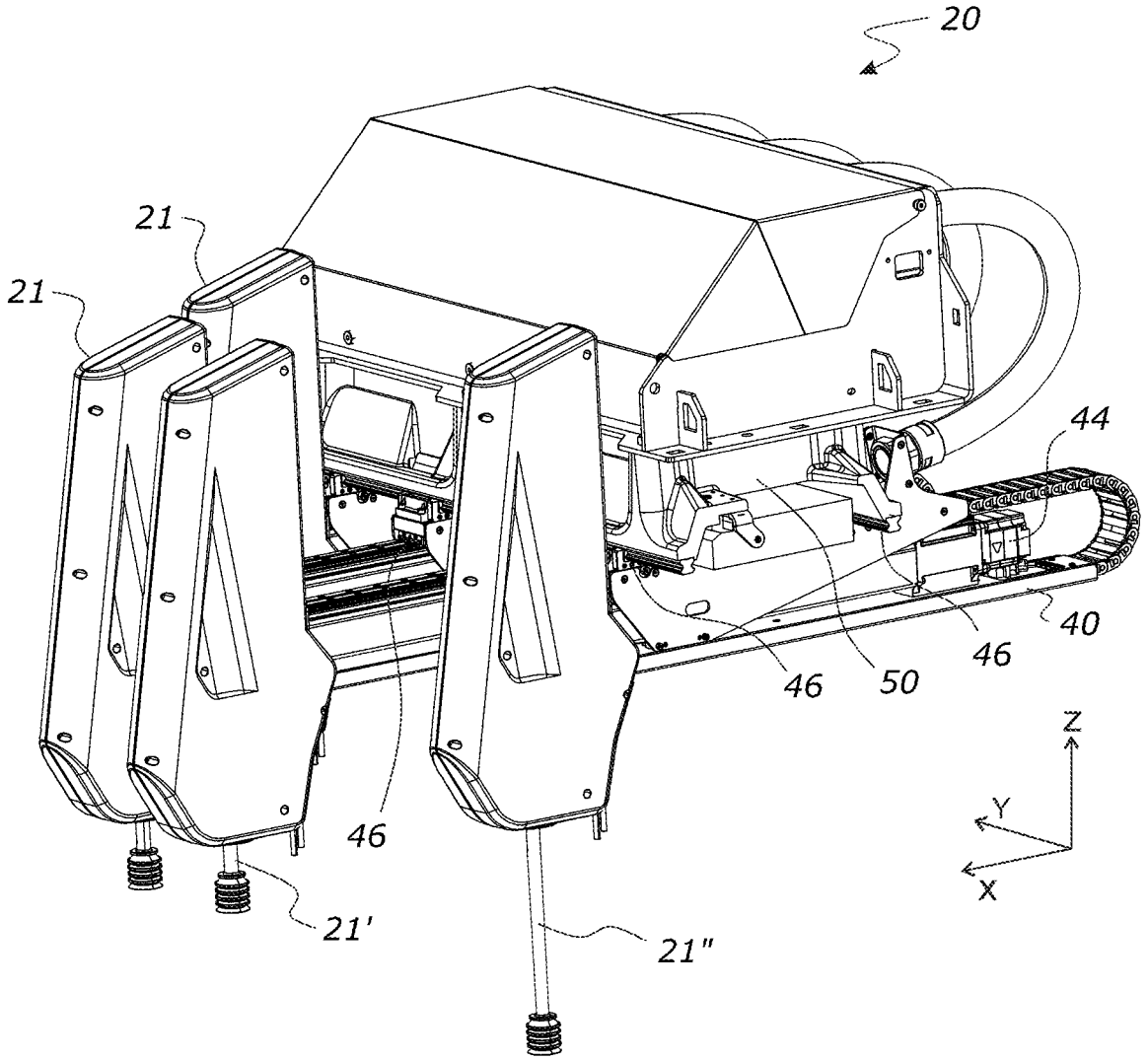
FIG. 2 shows a perspective view of a pick and place robot.

The robot 1 for packing produce comprises a pick and place robot 20, best shown in FIG. 2. In the preferred configurations, the robot 1 as shown in FIG. 1, has a packing area 4 which the pick and place robot 20 operates in. In the packing area 4, the produce 3 is transported by the pick and place robot 20 from a number of pickup locations 14, to a drop off zone 5 where the produce is packed by the robot onto receptacles 7. The receptacles 7 preferably have a number of drop off locations 6 for placing the produce 3 as referenced in FIG. 10.

Figure 10:
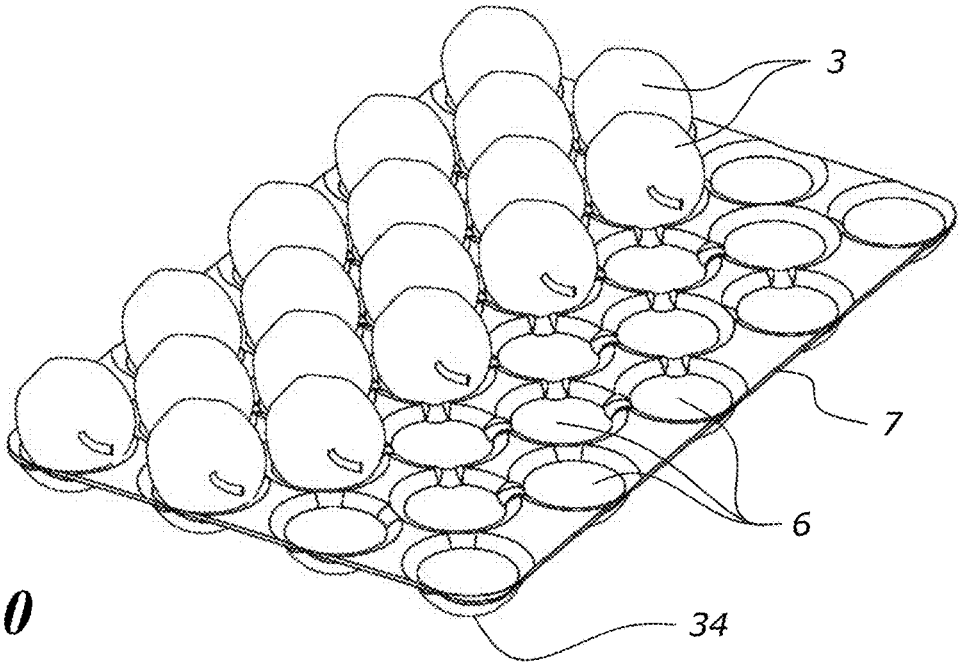
FIG. 10 shows a receptacle or tray partially filled with produce.

The receptacles 7 may be in the form of trays as shown in FIG. 10, having an array of depressions or pockets 34 for receiving items of produce. Alternatively, the trays may have substantially flat internal surfaces, without depressions for receiving produce. Further alternatively, the receptacles 7 may be in the form of boxes with upwardly extending sides and a substantially flat base, or punnets, or bags.

In some configurations, the robot 1 drops the produce 3 in known drop off locations 6 (e.g. the same trays are provided with the same number and position of drop off locations).

In the preferred configurations, the robot 1 can dynamically detect the drop off locations 6 (i.e. the drop off locations do not need to be known at the outset). For example, the drop off locations 6 may be detected by cameras.

The robot 1 guides the produce 3 to the pickup locations 14 for pick up. In the preferred configurations, produce 3 enters into the robot 1 by an accumulator 2 (shown in FIG. 12). Produce 3 may be fed to the accumulator 2 either manually or by an external feed source, such as a conveyor (not shown) or any other suitable means.

Figure 8:
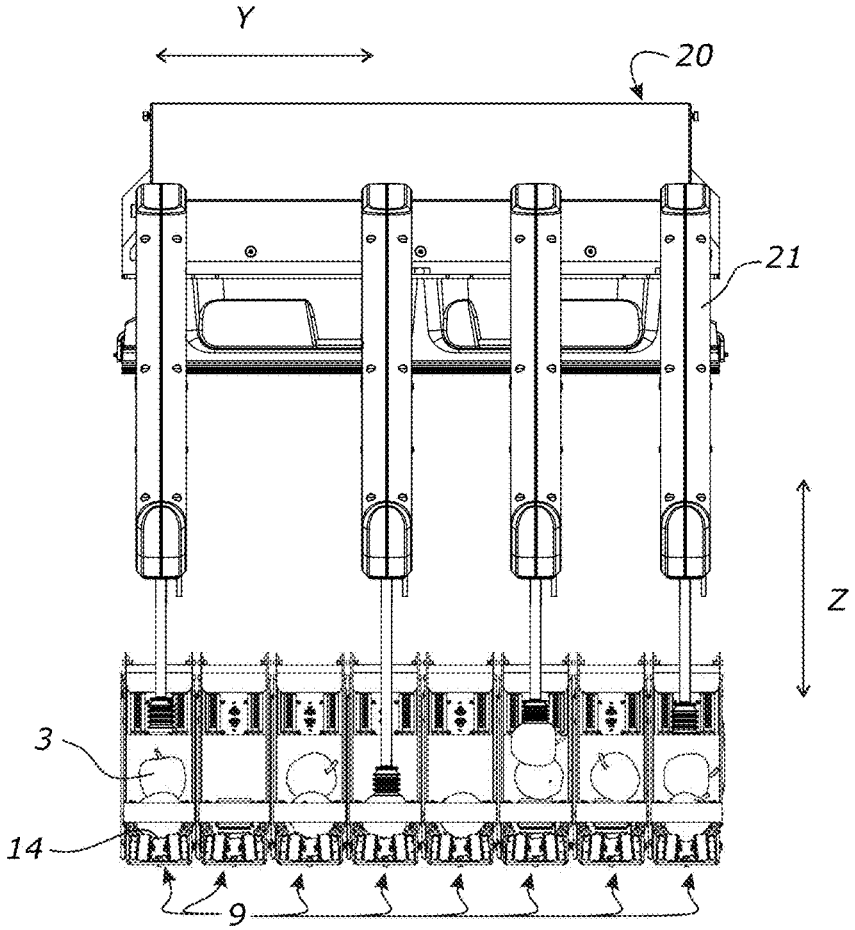
FIG. 8 shows a front view of the robot showing the individual heads spaced between different pickup locations, with heads having picked up an item of produce, in the process of picking up an item of produce and without an item of produce.
Figure 12:
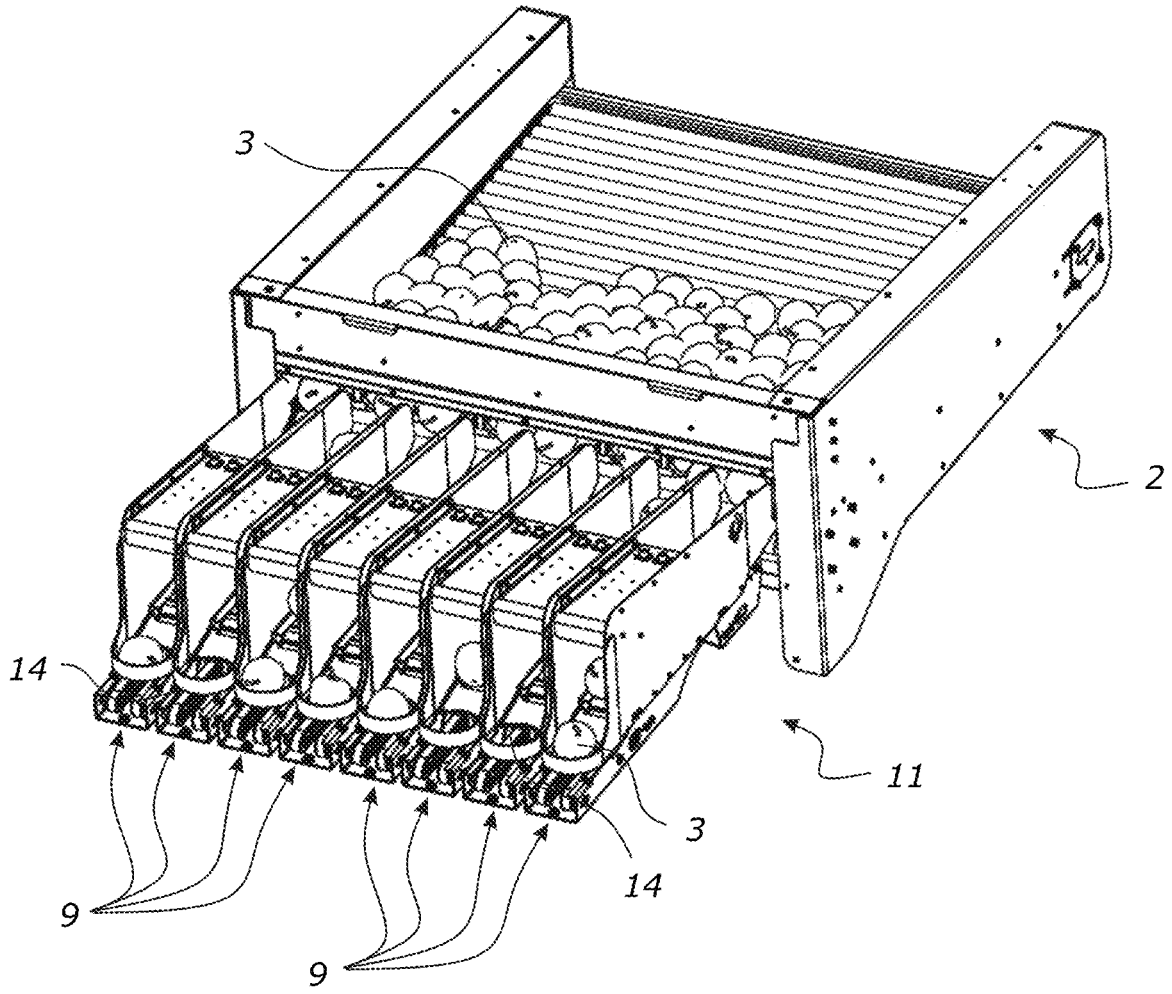
FIG. 12 shows a perspective view of an accumulator and produce orientation unit with some produce at the pickup locations.

Preferably, the robot 1 provides channels for spacing the produce 3 into lanes 9, such that only a single item of produce 3 passes to each pick up location 14 at a time. In these configurations, a unit 11 separates the produce 3 into lanes 9 for pick up (as shown in FIG. 8). In some configurations, the produce 3 passes from the accumulator 2 to the unit 11 for separating into lanes 9, as shown in FIG. 12.

In some configurations, the unit 11 is a produce orientation unit which changes the orientation of the produce 3 to a desired pickup orientation. The desired pickup orientation may be based on a physical feature of the produce 3, such as an anatomical feature, e.g. the stem and/or calyx of an apple. Alternatively, or in addition, the feature may be based on a desired colour, texture, pattern, size, perimeter or some other definable feature of the produce.

In some configurations, the robot 1 can reject produce 3 based on one or more detected physical features.

In the preferred configurations, the robot 1 comprises a receptacle conveyor 8 which passes beneath the accumulator 2 and produce packing area 4. The receptacle conveyor 8 transports the receptacles 7 to the drop off zone 5 for packing, and then transports the receptacles away from the packing area.

In the preferred configurations, the receptacle conveyor 8 also moves the receptacle 7 during packing, such that empty rows of the receptacle can be presented beneath the pick and place robot 20 to receive produce 3. The robot 1 controls the motion of the receptacle conveyor 8 to supply drop off/placement locations for the pick and place robot 20.

Figure 6:
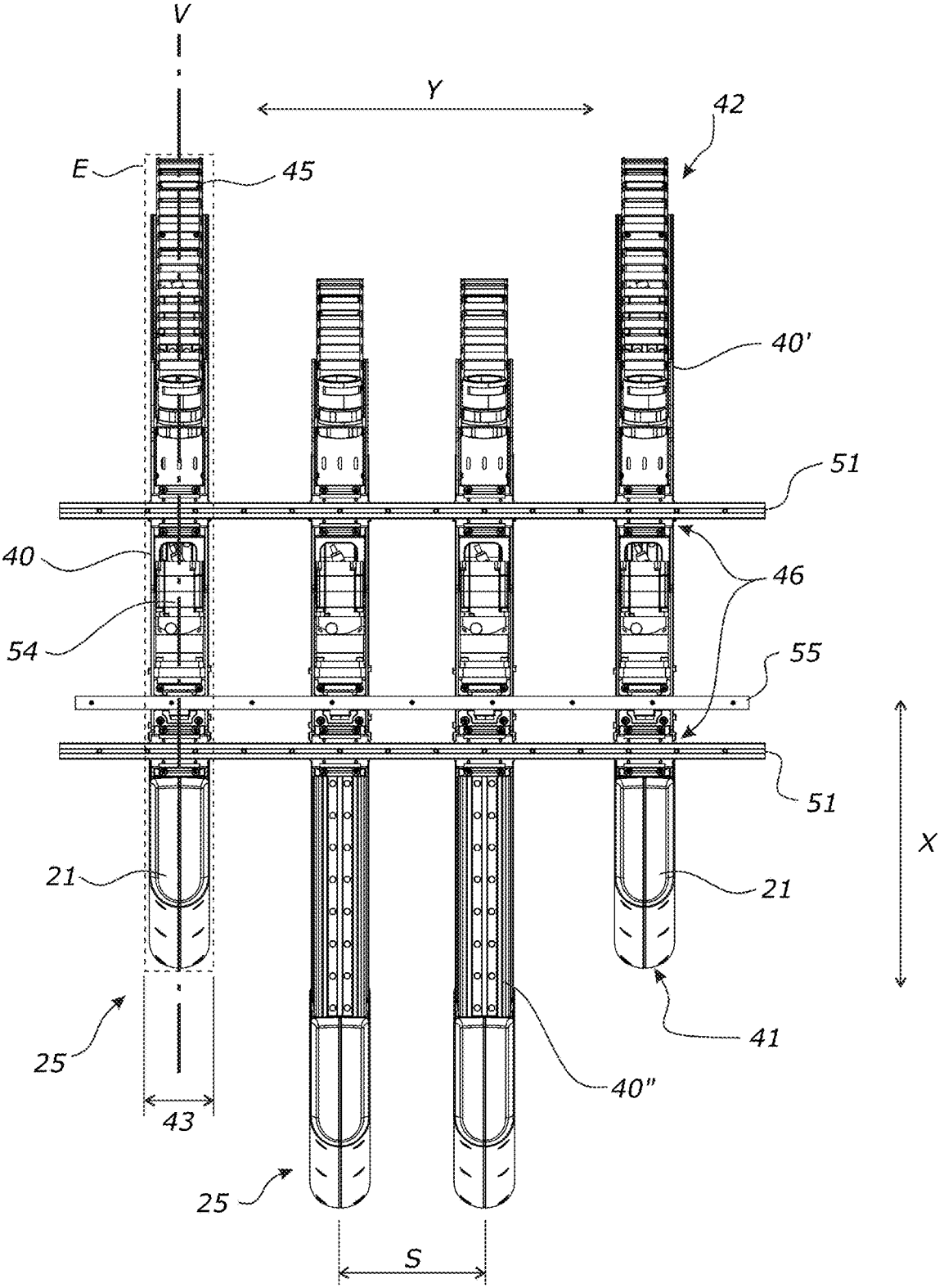
FIG. 6 shows a plan view of the pick and place robot.
Figure 7:
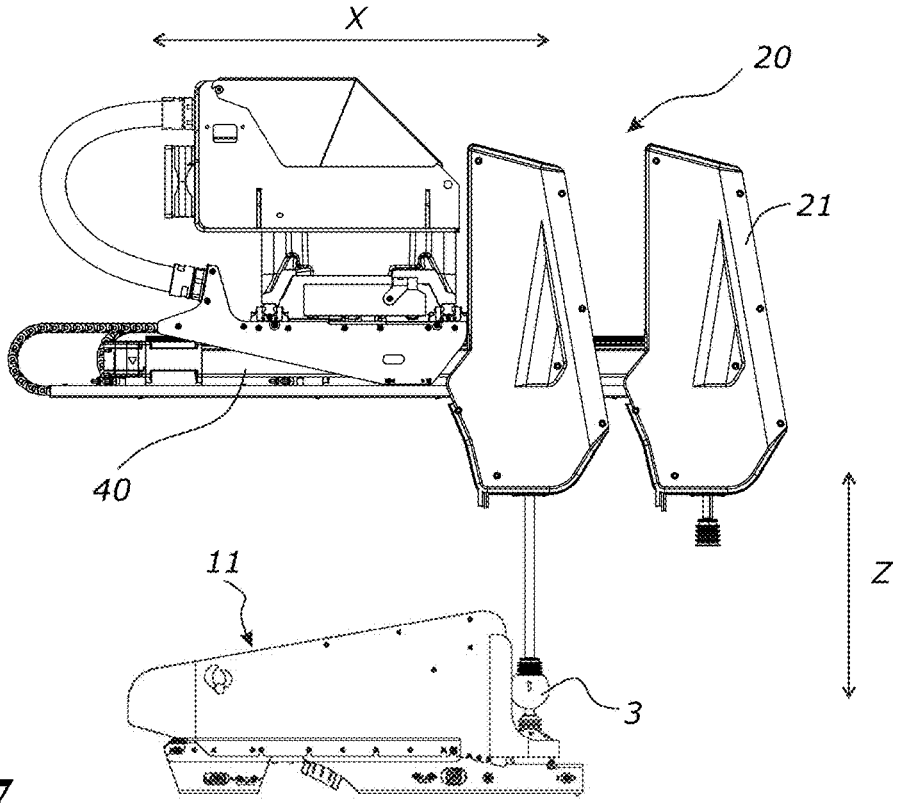
FIG. 7 shows a side view of the pick and place robot and a produce orientation unit.

As best shown in FIGS. 2 and 6, the pick and place robot 20 has a plurality of longitudinal carriage arms 40 arranged in an array. A fixed support unit 50 supports the plurality of longitudinal carriage arms 40. The fixed support unit 50 is a fixed structure in the robot 1. In the preferred configurations, the fixed support unit 50 is located at or towards the top region of the robot 1, such that packing can occur below the unit.

Preferably, the array is a regular array, arranged in a straight line (e.g. when the carriage arms 40 are fully retracted or fully extended). Alternatively, the carriage arms 40 may be arranged in a staggered array, or in an irregular array.

The pick and place robot 20 has a plurality of heads 21 for picking up and dropping produce 3, and also optionally rotating produce. Each head 21 is connected to a longitudinal carriage arm 40.

A plurality of heads 21 is two or more heads. In the illustrated and preferred configuration, the robot 1 has four heads 21 for picking up and dropping off produce 3.

In the preferred configurations, each head 21 is connected at or towards a front end 41 of the longitudinal carriage arm 40. Each pickup head 21 is preferably able to rotate the shaft 21 about a substantially vertical axis. Preferably a rotation actuator is provided within the pickup head 21 housing as is generally known in the art, or alternatively a linear rotary motor, or other suitable combined linear/rotation actuator can be utilized.

Figure 3:
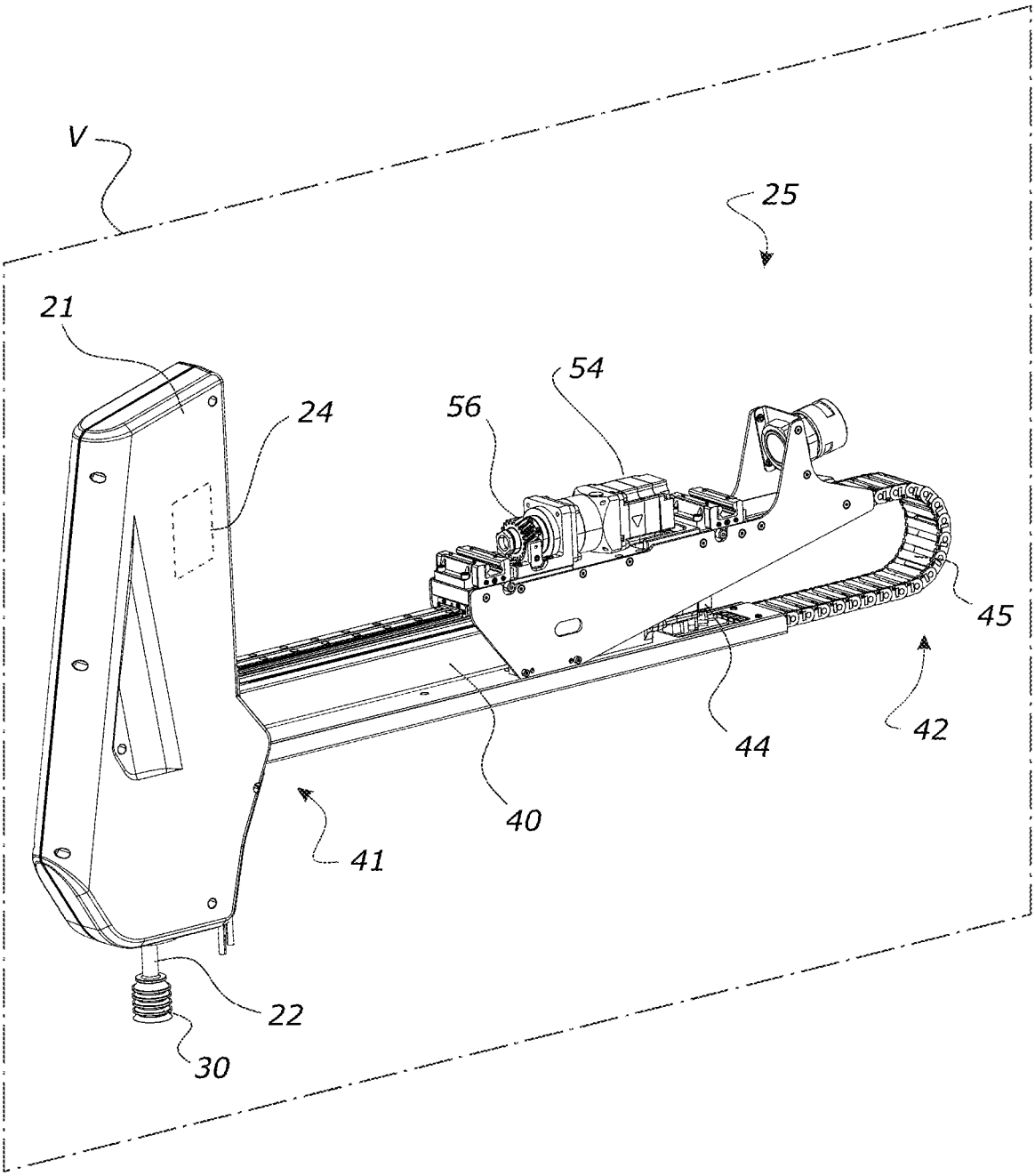
FIG. 3 shows a perspective view of a single unit of the pick and place robot having a pick-up head connected to a longitudinal carriage arm.

Preferably, the pick and place robot 20 comprises a plurality of pickup units 25 slidably mounted in the lateral direction (Y) onto the fixed support unit 50. Preferably the pickup units 25 are also able to rotate produce about a substantially vertical axis. The separate pickup/rotate units 25 being the independently movable carriage arms 40, connected heads 21, drive modules 44, 54 and other integrated components of the carriage arm as shown in FIG. 3.

The produce packing robot 1 has a longitudinal axis (X), a lateral axis (Y) and a vertical axis (Z). The pick and place robot 20 moves:

a) longitudinally (forwards and backwards) along the longitudinal axis (X) between the pick-up location 14 and drop off locations 6;

b) laterally (side-to-side) along the lateral axis (Y) between lanes 9 of the robot; and c) vertically (upwards and downwards) to pick up, hold and drop off an item of produce 3 along the vertical axis (Z).

d) Rotationally about vertical axis (Z).

The pick and place robot 20 moves in these 3 translation directions (X, Y, Z) and one rotational degree of freedom, to pick produce 3 from the pickup locations 14 when the produce is ready, and to drop off the produce to the drop off locations 6, which are empty.

The longitudinal carriage arm 40 extends and retracts in the longitudinal direction (X) to pick and place items of produce 3 from an array of pick up locations 14 to an array of drop off locations 6 for the produce. The arrays may be regular, staggered, or irregular.

In the preferred configurations, the longitudinal carriage arms 40 are independently movable between an extended condition 40" and retracted condition 40' in the longitudinal direction (X). The longitudinal carriage arms 40 in the extended condition 40" and retracted condition 40' are referenced in FIGS. 4 and 6.

Each carriage arm 40 can independently move in the longitudinal direction, such that the arms of the robot 1 do not move together in the longitudinal direction to pick up and place the produce 3.

It should be appreciated, that carriage arms 40 independently movable in the longitudinal direction will allow each pick up/rotate unit 25 to move between the pickup locations 14 when the produce 3 is ready to be picked up from particular lanes and to the drop off locations 6.

The produce 3 may be ready to be picked up from the pickup locations 14 at different times in different lanes 9. For example, the time required to transport the produce 3 to the pickup location 14, and/or to orientate the produce may be different for different produce.

Further, carriage arms 40 independently movable can drop off produce 3 to different rows or columns in the receptacle 7.

Preferably, when the longitudinal carriage arm is in the retracted condition 40', the pickup head 21 is located at or towards the pickup locations 14. Preferably, when in the longitudinal carriage arm is in the extended condition 40", the pickup head is located at or towards the drop off locations 6.

Figure 4:
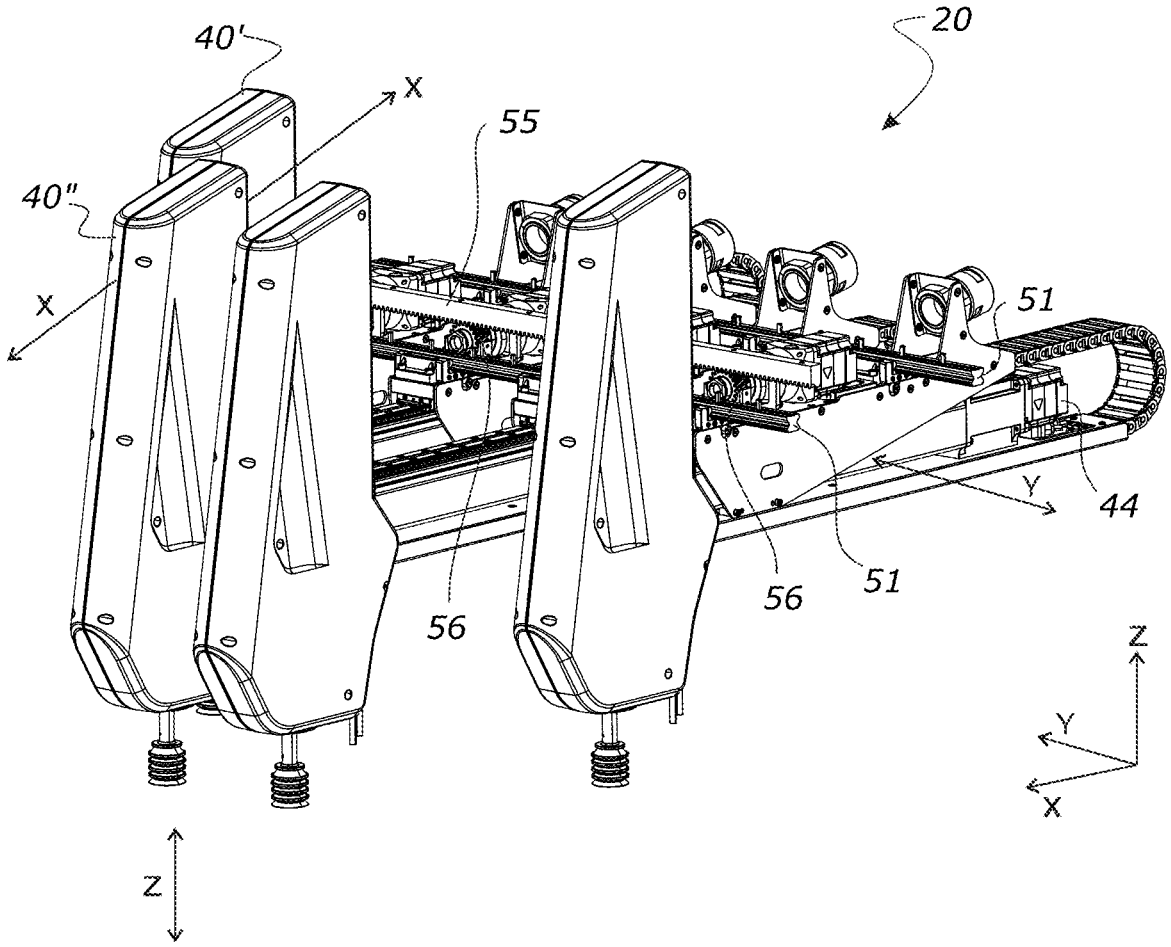
FIG. 4 shows a perspective view of the pick and place robot with lateral rails which the longitudinal carriage arms move laterally along.
Figure 5:
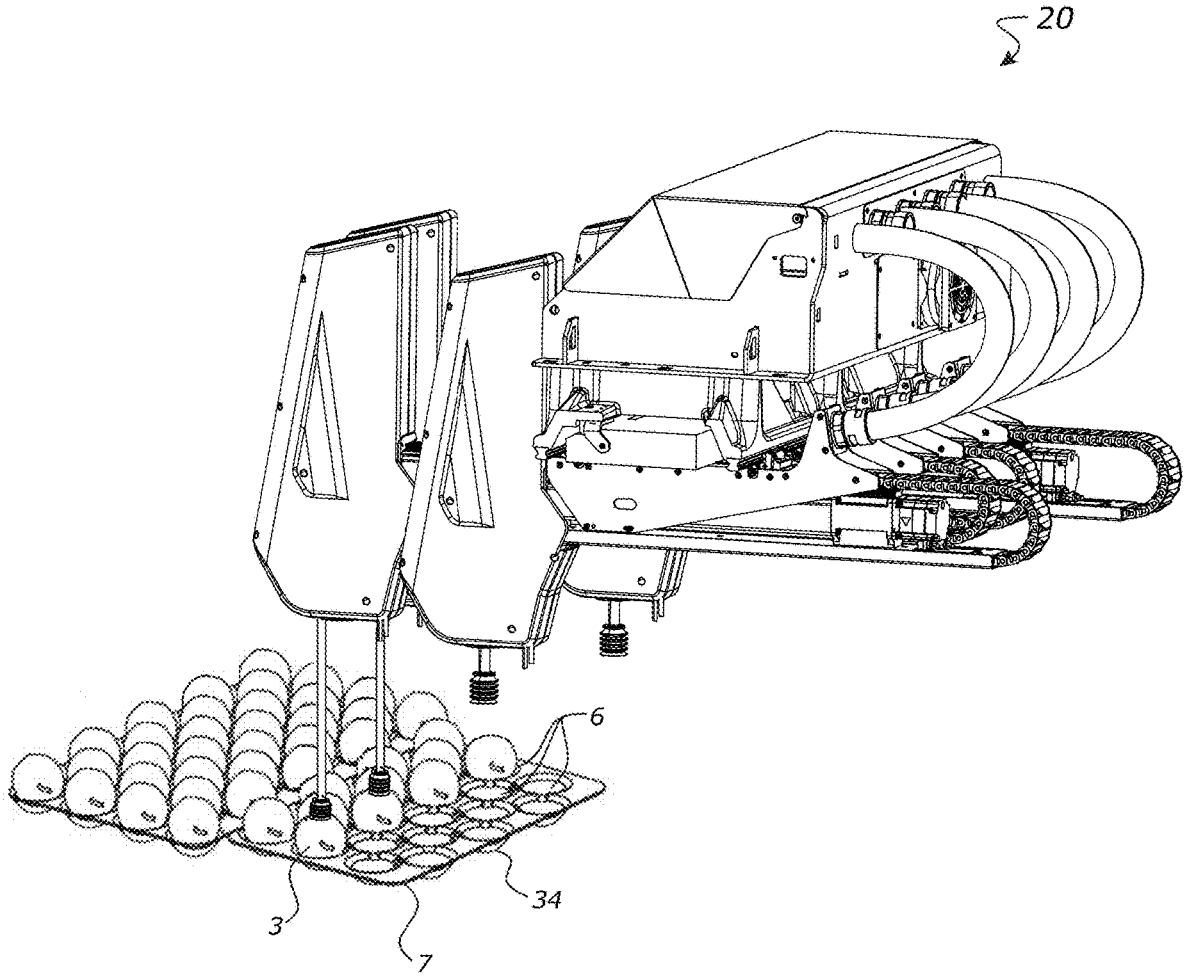
FIG. 5 shows a perspective view of the pick and place robot located over and dropping produce into drop off locations in the receptacles.

As referenced in FIGS. 4 and 6, in the preferred configurations, the length of a longitudinal carriage arm in the extended condition 40" is longer than when it is in the retracted condition 40'.

Preferably, each longitudinal carriage arm 40 is cantilevered off the fixed support unit 50. The longitudinal carriage arm 40 is cantilevered as it is mounted to and projects out from the fixed support unit 50. Each longitudinal carriage arm 40 is mounted to the fixed support unit 50 at an attachment region 46 as referenced in FIGS. 2 and 6.

Preferably, the heads 21, which are connected to the longitudinal carriage arm 40, depends from and is supported at a distance by the fixed support unit 50. The heads 21 are supported at a distance in particular when the carriage arms 40 are in an extended condition 40".

Preferably, each longitudinal carriage arm 40 is mounted to the fixed support unit 50 at or towards a back end of the longitudinal carriage arm in the extended condition 40".

The attachment region 46 is fixed and the pickup/rotate units 25 are supported even as the heads 21 moves towards and away from the attachment region 46 in the longitudinal direction.

Cantilevered carriage arms 40 fixed and supported at a distance by the fixed support unit 50 can provide advantages such as providing space below and/or in front of the pickup/rotate units 25 for packing, servicing of the robot, keeping the packing area 4 clear (when the pickup units 25 are retracted 40', or have spaced out in the lateral direction) for sensing with the placement position detection sensor (camera) that is mounted above the placement area, etc., as discussed in more detail below.

Preferably, the robot 1 has a longitudinal drive module 44 for each longitudinal carriage arm 40 to drive movement in the longitudinal direction (X).

In the preferred configurations the longitudinal drive module 44 is an electric motor. In other configurations, other drive modules such as hydraulic, pneumatic, mechanical drives modules may be used.

In one configuration, the longitudinal drive modules 44 are servo motors coupled to ball screws or lead screws to actuate longitudinal motion. This motion could also be achieved with a servo motor or stepper motor coupled to ball screws, toothed belt systems or rack and pinon drive systems. Likewise, a linear motor could also be used to achieve the longitudinal motion.

It is anticipated that other suitable drive modules known to a person skilled in the art may be used to drive longitudinal movement of the pick and place robot 20.

In some configurations, the robot 1 has an energy chain 45 connected to the longitudinal drive module 44. The energy chain 45 supports the motion of electrical cables and pneumatic hoses for components associated with the carriage arms such as the motors, suction cups 30 of the pickup heads 21, and for movement of the longitudinal carriage arm 40 in the longitudinal direction (X).

In the preferred configurations, the energy chain 45 is located at or towards a back end 42 of the longitudinal carriage arm 40. The energy chain 45 located at the back end 42 allows the energy chain to be aligned with the carriage arm 40 in the longitudinal direction, providing a slim design.

The longitudinal carriage arm 40 moves in the lateral direction (Y) to move between different lanes 9 of the robot 1 and to move to different drop off locations 6. Accordingly, the heads 21 move in the lateral direction (Y) with the carriage arms 40 it is attached to.

The heads 21 may need to move laterally (Y) (across the different lanes 9), as the number of heads 21 in the preferred configurations may be less than the number of pickup locations 14 for the produce 3, and/or the number of heads is less than the number of drop off locations 6 for the produce.

In some configurations, the heads 21 may additionally or alternatively need to move laterally (Y) if the pickup locations 14 are not aligned with the drop off locations 6.

In the preferred configurations, the total number of pick up locations 14 is greater than the total number of drop off locations 6 on the receptacle 7.

Greater number of pickup locations 14 than pickup heads 21 and/or drop off locations 6, can improve the efficiency of packing for some produce (e.g. where produce takes some time to be prepared for pickup, such as where the produce is complex to orientate due to its shape). A greater number of produce 3 can be prepared for pickup, while the heads 21 transport the produce to the receptacle 7.

In configurations where the produce 3 is less complex, and do not take much time to orientate or otherwise prepare for pickup, the number of pickup locations 14 may be the same as the number of pickup heads 21, or fewer pickup locations 14 may be necessary.

In the preferred configuration, the robot 1 has approximately double the number pickup locations 14 than it has heads 21. However, it is expected that the ratio of pick up locations 14 and heads 21 may be customized to suit the robot. For example, the ratio may be dependent on the time commonly taken for the produce 3 to be ready for pickup. Having more pickup locations 14 allows the robot 1 to operate more efficiently, by making it more likely that all the pickup heads 21 can immediately pick up produce 3 that is ready and waiting in at pickup locations 14.

In the preferred configurations, each longitudinal carriage arm 40 is independently movable in the lateral direction (Y) to adjust relative spacing between the plurality of heads 21 such that the heads can move independently across lanes 9 of the robot. Different relative spacing between the heads 21 is shown in FIG. 8.

The heads 21 move laterally to the lane 9 in which the produce 3 is ready for pick up, and/or to the lane which is empty in the receptacle 7 for drop off.

The heads 21 of the robot may be in any desired positions along the lateral axis (Y) however the heads 21 may not overlap each other.

In some configurations, not all heads 21 may service all pickup locations 14.

In some configurations, the fixed support unit 50 comprises two lateral rails 51 being in a direction orthogonal to the longitudinal carriage arms 40, as shown in FIGS. 4 and 6. Preferably, each longitudinal carriage arm 40 is slidably mounted to the two lateral rails 51 such that the arms can move in the lateral direction (Y).

In the illustrated configuration, the two lateral rails 51 are fixed to an underside of the fixed support unit 50.

Preferably, the robot 1 has a lateral drive module 54 for each longitudinal arm to drive movement in the lateral direction relative to the fixed support unit.

In some configurations, the lateral drive module 54 drives a rack 55 and pinion 56 mechanism to move each longitudinal carriage arm 40 in the lateral direction (Y).

The rack 55 is fixed to the fixed support unit 50 and each longitudinal carriage arm 40 comprises a pinion 56 which engages and moves along the rack.

It is anticipated that other mechanism for driving the longitudinal carriage arm 40 in the lateral direction may be used.

In the preferred configurations, the longitudinal 44 and lateral drive modules 54 are electric motors. In other configurations, other drive modules such as hydraulic, pneumatic, mechanical drives modules may be used.

In one configuration, the longitudinal 44 and lateral drive modules 54 are servo motors coupled to a gearbox that drives the pinion 56. Alternatively, stepper motors or linear motors could be used to drive the robot 1 in the longitudinal direction. The stepper or servo motor options could also power a ball screw, lead screw or toothed timing belt linear actuation systems to achieve the same motion in the lateral direction. A benefit of using a coaxial motor and ball screw design is that it reduces the overall width of the unit allowing tighter space considerations.

It is anticipated that other suitable drive modules known to a person skilled in the art may be used to drive longitudinal or lateral movement of the pick and place robot 20.

Preferably, the longitudinal drive module 44 and lateral drive module 54 are mounted onto the carriage arm 40 it drives as shown in FIGS. 2 and 3.

The pickup heads 21 move in the vertical direction (Z) to move between a lowered position 21" to pickup or drop off produce 3, and a raised position 21' to move the head into the open space above the produce.

In the preferred configurations, each head 21 is independently movable in the vertical direction (Z) to pick up, hold or rotate, and drop off an item of produce 3.

Preferably, the robot 1 has a vertical drive module 24 to move the head 21 between a raised head position 21' and a lowered head position 21" as referenced in FIG. 2.

Most preferably, the vertical drive module 24 is fixed to the head 21, such that the vertical drive modules 24 move with the head 21 as the pickup/rotate unit 25 moves in the longitudinal (X) and/or lateral (Y) directions.

In some configurations, the vertical drive module 24 is housed within a housing unit of the head 21 as indicated in FIG. 3. The housing unit of the head 21 provides an enclosure which protects the components of the head, and an aesthetically desirable unit. Preferably, the head 21 also houses a rotation actuator to allow the shaft of the pickup head to rotate about its vertical axis, in order to rotate the produce as required.

In the preferred configurations, the vertical drive module 24 is an electric servo motor which drives the head 21 between the raised and lowered positions, and also includes a rotation actuator.

In other configurations, other drive modules such as pneumatic, hydraulic, mechanical drives modules may be used.

In one configuration, the vertical drive module 24 is a servo motor to drive the head 21 in the vertical direction by ball screw, lead screw or toothed timing belt linear actuation systems.

It is anticipated that other suitable drive modules and/or mechanisms known to a person skilled in the art may be used to drive vertical movement of the head 21.

In the preferred configurations, each head 21 comprises a rod 22 movable between the raised head position and lowered head position to pick up and drop off produce 3.

Preferably, on the end of each head 21 is a produce holder 30 for picking up, holding or rotating, and dropping off the items of produce 3. In the preferred configuration the produce holder is in the form of a suction cup 30, located at a distal end of the rod 22.

When a suction cup 30 is located against an item of produce 3, a vacuum can be provided to the suction cup 30, such that the item of produce may be held by the suction cup in order to be transported for packing. Upon arrival at a desired drop off location 6, the vacuum may stop, or a positive pressure may be provided to the suction cup in order to release the item of produce 3. Vacuum can be applied to the suction cup 30 via pneumatic line.

Preferably, the robot 1 has a controller to control the movement of the robot (i.e. movement in the longitudinal, lateral and vertical directions). The controller coordinates the simultaneous motion of all axes (including rotation about a vertical axis) to ensure that the optional path between the starting point and end point is taken.

Preferably, in making decisions regarding picking up and dropping off produce, the controller may be programmed to operate the produce pick and place robot 20 in a way which increases the rate at which produce 3 is packed by strategically moving and using the heads 21 to pick up produce as it is ready for pick up, and to move it to the empty drop off locations 6.

The controller can receive signals, such as from cameras. The controller processes these signals, moves and tracks the locations of the heads 21 and controls when and how items of produce 3 are picked up from the pickup locations 14 and dropped off at the drop off points 6.

The controller preferably controls the movement of the carriage arms 40 and heads 21 such that crossovers or collisions of the carriage arms and heads are prevented.

To prevent collisions the controller can set distance limits in the X, Y and Z directions for each head 21. Movement in the lateral direction (Y) is preferably limited such that the heads 21 are not allowed to come close enough together that they collide. Movement in the vertical direction (Z) is software limited in areas where there is fixed structure below the head 21 so that it does not collide with that structure.

As shown in plan view on FIG. 6, in the preferred configurations, the pickup/rotate units 25 have a slim design, so that multiple pickup units 25 can operate side-by-side in the packing area 4.

It should be appreciated that the slim profile of the pickup units 25 allow the plurality of heads 21 to move close together to pick up from pick up locations 14 (FIG. 8) and drop off locations 6 (FIG. 10) which are close together.

Preferably, the distance between the heads 21 is minimized, such that produce 3 can be picked up and dropped off close together to allow for a more compact robot 1 (i.e. smaller packing area 4 required), and so the produce can be packed compactly onto the receptacles 7 for transport.

In some configurations, the slim profile of the pickup units 25 allow for more clear space in the packing area 4, which can help with serviceability.

The preferred spacing between the heads 21 may be determined by the size of the produce. For example, the minimal lateral spacing (S) between the central axis of the heads that can be achieved is preferably less than 1 times the width of the produce it picks and drops.

Figure 9:
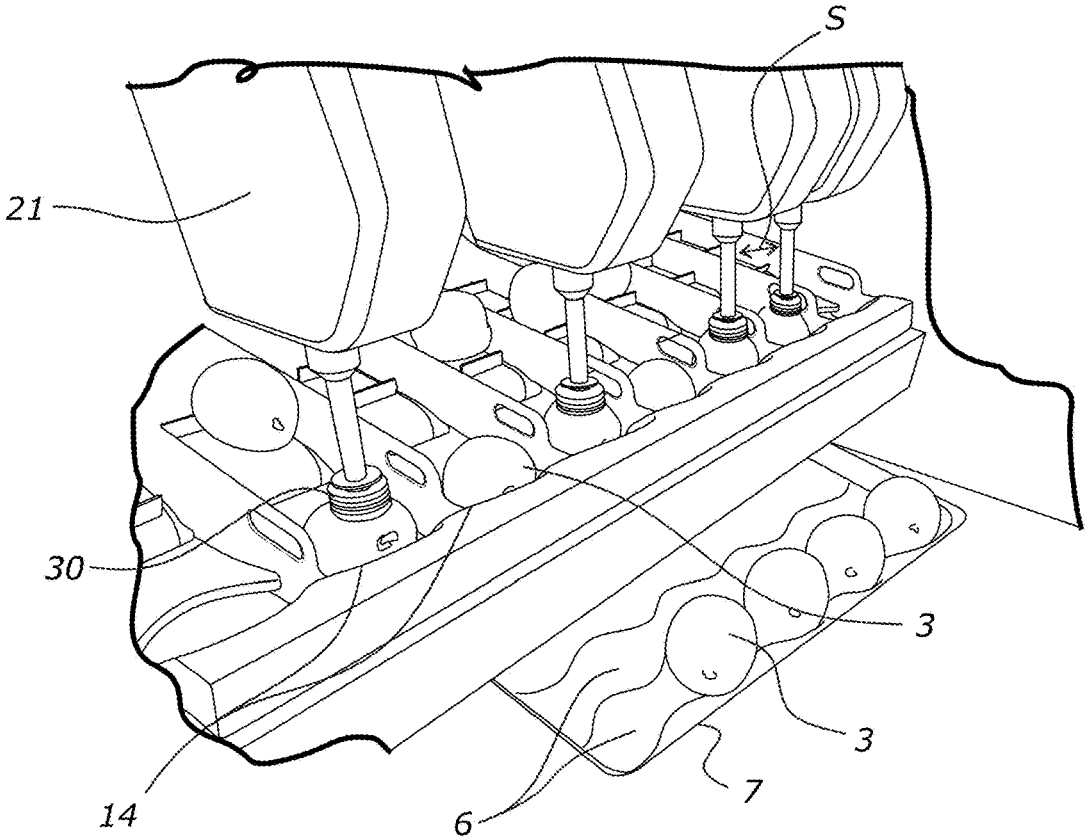
FIG. 9 shows a close-up partial view of the pick-up heads at the pick-up locations and a partially filled receptacle.

In the preferred configurations, the plurality of heads 21 can move laterally towards each other to achieve a minimal lateral spacing (S) of less than 110 mm between the central axis of the heads, as referenced in FIGS. 6 and 9. This spacing is achieved so that two or more adjacent heads 21 can service adjacent lanes (e.g. to pick up produce 3 from adjacent pickup locations 14 or drop off produce at adjacent drop off locations 6 at the same, or close to the same time).

In the most preferred configurations, the plurality of heads 21 can move laterally towards each other to achieve a minimal spacing (S) of less than 80 mm between the central axis of the heads.

The heads 21 can be spaced laterally apart as wide as the lateral axis (Y) allows minus the width of the heads.

To provide a slim pickup/rotate unit 25, preferably the head 21 and longitudinal carriage arm 40 lie within a generally rectangular envelope (E) in plan view as shown in FIG. 6. The rectangular envelope is substantially as wide as the longitudinal carriage arm 40, such that the envelope is about as wide at the widest width of the longitudinal carriage arm.

Preferably substantially as wide as the longitudinal carriage arm 40 can be defined as the same or no more than 30% wider than the carriage arm.

More preferably, the envelope is no more than 20% wider than the carriage arm.

In some configurations, the envelope is no more than 10% wider than the carriage arm.

Preferably, the width 43 of the rectangular envelope (E) is approximately 40 to 150 mm wide. Most preferably, the width 43 of the rectangular envelope (E) is approximately 50 to 80 mm wide.

Preferably, most of the components integrated with the carriage arm (for example, the head 21, longitudinal and lateral drive modules 44, 54, energy chain 45) are approximately the same width (e.g. the same or not more than 30% wider) or are less wide than the carriage arm width.

More preferably, the components are no more than 20% wider than the carriage arm.

In some configurations, the components are no more than 10% wider than the carriage arm.

Most preferably, all components integrated with the carriage arm 40 are approximately the same width or less wide than the carriage arm width.

Preferably, each head 21 is substantially as wide as the longitudinal carriage arm 40 it is connected to. Substantially as wide as the longitudinal carriage arm 40 can be defined as the same width or no more than 30% wider than the carriage arm.

More preferably, the head is no more than 20% wider than the carriage arm.

In some configurations, the head is no more than 10% wider than the carriage arm.

The head 21 may be less wide than the longitudinal carriage arm 40 in some configurations.

Preferably, the longitudinal drive module 44 lies within the generally rectangular envelope (E) in plan view.

Preferably, the longitudinal drive module 44 is not substantially wider than the width 43 of the longitudinal carriage arm.

In some preferred configurations, the longitudinal drive module 44 is less wide than the width 43 of the longitudinal carriage arm.

Preferably, the energy chain 45 and/or services lie within the generally rectangular envelope (E) in plan view. Services may include electrical lines, data cables etc. required in the operation of the robot 1, such of which may be associated with individual carriage arms 40.

Preferably, the energy chain 45 is substantially as wide as the longitudinal carriage arm 40 it drives.

In some configurations, the energy chain 45 is less wide than the longitudinal carriage arm 40 it drives.

Preferably, the lateral drive module 54 lies within the generally rectangular envelope (E) in plan view.

Preferably, the lateral drive module 54 is not substantially wider than the width 43 of the longitudinal carriage arm 40.

Preferably, the lateral drive module 54 is less wide than the width 43 of the longitudinal carriage arm.

To provide a slim pickup/rotate unit 25, preferably one or more of the components integrated with the carriage arm 40 are aligned longitudinally with the longitudinal (X) carriage arm 40, as shown in FIG. 6. Most preferably, all the components integrated with the carriage arm 40 are aligned longitudinally with the longitudinal (X) carriage arm 40.

Most preferably, one or more of the components are substantially centred along the longitudinal axis (X) of the longitudinal carriage arm 40 it is connected to.

Preferably, the longitudinally aligned components are on top of, below, at a front end or back end of the carriage arm 40 it is connected to. Most preferably, the components are fixed to a top side or back end of the carriage arm 40 such the area below and in front of the arms are clear for servicing the robot (discussed below).

Preferably, the longitudinally aligned components are not fixed to a side of (i.e. laterally (Y) connected to) the carriage arm 40.

In the preferred configurations, each head 21 is aligned longitudinally with the longitudinal carriage arm 40 it is connected to.

In the preferred configurations, the longitudinal drive module 44 is elongate and aligned longitudinally with the longitudinal carriage arm 40 it drives.

In the preferred configurations, the energy chain 45 and/or services are aligned longitudinally with the longitudinal carriage arm 40 it drives.

In the preferred configurations, the lateral drive module 54 is elongate and aligned longitudinally with the longitudinal carriage arm 40 it drives.

To provide a slim pickup and rotation unit 25, preferably one or more of the components integrated with the carriage arm 40 are generally aligned on a vertical plane (V), as shown in FIGS. 3 and 6. Most preferably, all the components integrated with the carriage arm 40 are generally aligned on a vertical plane.

Alignment on the vertical plane (V) helps provide a slim profile of pickup units 25 to allow the plurality of heads 21 to move close together for pick up and drop off of produce 3.

In the preferred configurations, the head 21 and the longitudinal carriage arm 40 it is connected to are generally aligned on a vertical plane (V).

In the preferred configurations, the longitudinal drive module 44 and the carriage arm 40 it is connected to are generally aligned on a vertical plane.

In the preferred configurations, the energy chain 45 and/or services and the carriage arm 40 it is connected to are generally aligned on a vertical plane.

In the preferred configurations, the lateral drive module 54 and the carriage arm 40 it is connected to are generally aligned on a vertical plane.

Further to provide a slim pickup unit design, the vertical drive modules 24 are separated in the longitudinal direction from the longitudinal and lateral modules 44, 54. I.e. the drive modules which provide for movement of the arm in different directions, are spaced along the longitudinal direction.

Preferably, the vertical drive and rotation module 24 is located at the head 21 (towards or at a front end of the carriage arm), while the longitudinal and lateral modules 44, 54 are located towards or at a back end on the carriage arm 40.

The robot 1 for packing produce includes many components, some of which need to be serviced from time to time. The layout of the components of the robot 1, provides for improved ease of serviceability of the robot 1, allowing for the ability to maintain and repair components of the robot as required. Improved serviceability can reduce the time typically associated with maintaining and repairing components.

The area below the fixed support unit 50, longitudinal carriage arms 40, and heads 21 for servicing the robot 1, may be maximized when the heads are in the head retracted position 21' and/or the module carriage arms 40 are in the arm retracted position 40". Serviceability can be improved when components of the robot 1 are out of the way (to maximize the open space in the packing area 4).

The layout of components described provides a compact design which can also minimize the footprint of the robot 1, reducing the space required for the machine.

Further, the clean layout of the components described can also reduce the likelihood of damage to components, e.g. prevent collision of heads, tangling wires or belts, or damage to other components.

In the preferred configurations, the plurality of longitudinal carriage arms 40 are mounted below the fixed support unit 50.

In the preferred configurations, each head 21 is connected at or towards a front end 41 of the longitudinal carriage arm 40.

It should be appreciated in these configurations more space is provided below and/or in front of the pickup units 25 for packing and/or servicing of the robot 1.

In some configurations, the longitudinal carriage arms 40 are mounted above the fixed support in 50.

Further, cantilevered carriage arms 40 fixed and supported at a distance by the fixed support unit 50 can provide space below and/or in front of the pickup units 25 for servicing the robot.

In some configurations, the robot 1 further comprising a front access door 19. The doors 19 are preferably located at the front 16 of the robot 1, where the produce 3 exit and are transported away in receptacles 7.

The front access door 19 may be closed when the robot 1 is not operating to protect the components e.g. from dust or damage.

Components of the robot 1 can be difficult to access from the side.

Furthermore, different lanes 9 of the robot 1 cannot be easily accessed from the side. It should be appreciated, a front access door 19 can provide advantages over side access doors.

A front access door(s) 19 can be particularly useful for double apple packers (described below), to access the different lanes 9 of the robot.

Preferably, the front access door(s) 19 are movable between a closed door position and an open door position. Preferably, each lane 9 of the robot can be serviced from the front when the door 19 is in the open door position.

In some preferred configurations, the front access door(s) 19 are vertically slidable between a lowered door position (FIG. 1) and a raised door position (FIG. 2). Preferably, each lane 9 of the robot can be serviced from the front when the door 19 is in the raised door position.

Figure 11:
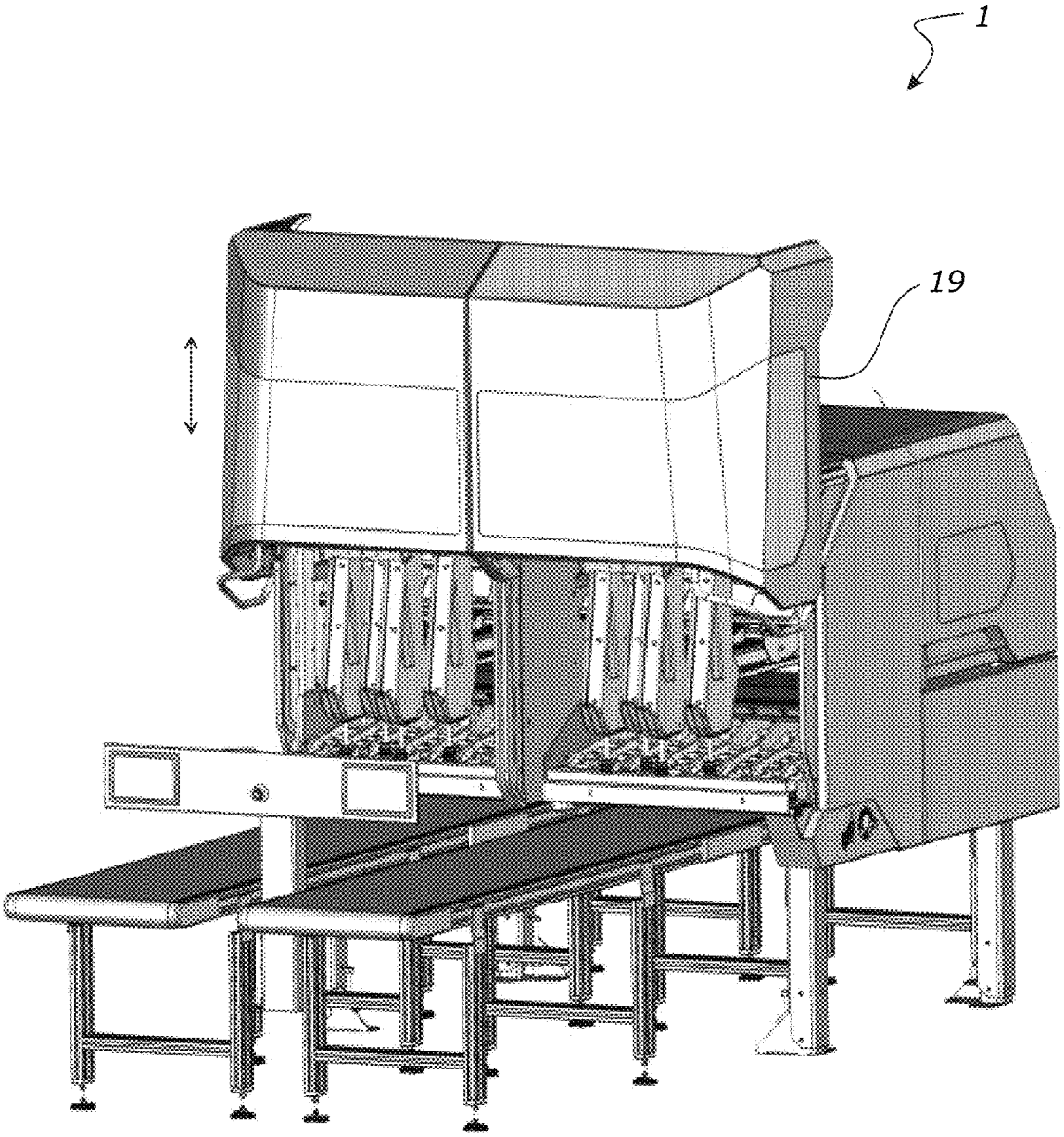
FIG. 11 shows a perspective view of a robot for packing produce having front access doors in a raised position.

In some configurations, the robot 1 is a double produce packer having two adjacent stations as shown in FIGS. 1 and 11. In some configurations the produce packer robot is a multi-produce packer with more than two adjacent stations. Each station has a plurality of longitudinal carriage arms 40, a plurality of heads 21 for picking up produce 3, and a fixed support unit 50, as described above.

In the preferred configurations, the adjacent stations are located side-by-side.

The double or multi produce packer provides increase output of packed produce 3 by a single robot 1.

To those skilled in the art to which the invention relates, many changes in construction and widely differing embodiments and applications of the invention will suggest themselves without departing from the scope of the invention as defined in the appended claims.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention claimed is:

1. A robot for packing produce having a longitudinal axis, a vertical axis and a lateral axis, the robot comprising:

a plurality of longitudinal carriage arms arranged in an array, each longitudinal carriage arm independently movable between an extended condition and a retracted condition in a longitudinal direction;

a plurality of heads, each head connected to a longitudinal carriage arm and independently movable in a vertical direction to pick up, hold and drop off an item of produce; and a fixed support unit for supporting the plurality of longitudinal carriage arms;

a controller configured to control a first independent movement of a first longitudinal carriage arm comprised in the plurality of longitudinal carriage arms in a lateral direction relative to a second independent movement of a second longitudinal carriage arm comprised in the plurality of longitudinal carriage arms in the lateral direction to prevent collision between at least one of:

a first head of the first longitudinal carriage arm and the second longitudinal carriage arm, and a second head of the second longitudinal carriage arm and the first longitudinal carriage arm;

wherein the head and longitudinal carriage arm lie within a generally rectangular envelope in plan view, the rectangular envelope is substantially as wide as the longitudinal carriage arm; and wherein each longitudinal carriage arm is cantilevered off the fixed support unit; and wherein each longitudinal carriage arm is independently movable in in the lateral direction to adjust relative spacing between the plurality of heads such that the plurality of heads can move across lanes to pick or place the item of produce.

2. The robot according to claim 1, wherein at least one of:

each head is aligned longitudinally with the longitudinal carriage arm it is connected to, each head is also able to rotate produce about a vertical axis, each head is substantially as wide as the longitudinal carriage arm it is connected to, each head is connected at or towards a front end of the longitudinal carriage arm, the longitudinal carriage arm is elongated, a width of the rectangular envelope is approximately 40 to 150 mm wide, the first head of the first longitudinal carriage arm is generally aligned with the first longitudinal carriage arm on a vertical plane, the plurality of longitudinal carriage arms are mounted below the fixed support unit, the plurality of heads can move laterally towards each other to achieve a minimal spacing of less than 80 mm between a central axis of the plurality of heads, the plurality of heads can move laterally towards each other to achieve a minimal spacing of less than 110 mm between the central axis of the plurality of heads, each head further comprises a suction cup at a distal end of a rod for holding the item of produce, the produce is:

a. apples, b. avocados, and c. stonefruit, and the robot is a produce packer having two adjacent stations, each station comprising:

the plurality of longitudinal carriage arms, the plurality of heads, and the fixed support unit, the fixed support unit comprising two lateral rails in a direction orthogonal to the plurality of longitudinal carriage arms, each longitudinal carriage arm slidably mounted to the two lateral rails to move in the lateral direction.

3. The robot according to claim 1, further comprising a longitudinal drive module for each longitudinal carriage arm to drive movement in the longitudinal direction.

4. The robot according to claim 3, wherein at least one of:

the longitudinal drive module is less wide than a width of the longitudinal carriage arm, the longitudinal drive module is elongate and aligned longitudinally with the longitudinal carriage arm it drives, the longitudinal drive module and the longitudinal carriage arm it is connected to are generally aligned on a vertical plane, and the longitudinal drive module lies within the generally rectangular envelope in plan view.

5. The robot according to claim 3, further comprising an energy chain connected to the longitudinal drive module, wherein the energy chain is substantially as wide as the longitudinal carriage arm it drives.

6. The robot according to claim 5, wherein at least one of:

the energy chain and services comprising an electric line or a data cable are aligned longitudinally with the longitudinal carriage arm it drives, the energy chain or the services and the longitudinal carriage arm to which the energy chain or the services is connected are generally aligned on a vertical plane, and the energy chain and the services lie within the generally rectangular envelope in plan view.

7. The robot according to claim 1, further comprising a lateral drive module for each longitudinal carriage arm to drive movement in the lateral direction relative to the fixed support unit.

8. The robot according to claim 7, wherein at least one of:

the lateral drive module is less wide than a width of the longitudinal carriage arm;

the lateral drive module is elongate and aligned longitudinally with the longitudinal carriage arm it drives, the lateral drive module and the longitudinal carriage arm it is connected to are generally aligned on a vertical plane, the lateral drive module lies within the generally rectangular envelope in plan view, the longitudinal and lateral drive modules are mounted onto the longitudinal carriage arm it drives, and each longitudinal carriage arm is mounted to the fixed support unit at or towards a backend of the longitudinal carriage arm in the extended condition.

9. The robot according to claim 7, wherein the lateral drive module drives a rack and pinion mechanism to move each longitudinal carriage arm in the lateral direction.

10. The robot according to claim 9, wherein the rack is fixed to the fixed support unit and each longitudinal carriage arm comprises a pinion that engages and moves along the rack.

11. The robot according to claim 1, further comprising a front access door.

12. The robot according to claim 11, wherein at least one of:

the front access door is movable between a closed door position and an open door position, wherein each lane of the robot can be serviced from a front when the door is in the open door position, and the front access door is vertically slidable between a lowered door position and a raised door position, wherein each lane of the robot can be serviced from the front when the door is in the raised door position.

13. The robot according to claim 1, further comprising a vertical drive module to move the head between a raised head position and a lowered head position, the vertical drive module being fixed to the head.

14. The robot according to claim 13, wherein at least one of:

the vertical drive module is housed within a housing unit of the head, and each head comprises a rod movable between the raised head position and lowered head position to pick up and drop off produce.

15. The robot according to claim 1, wherein each of the plurality of longitudinal carriage arms extends and retracts in the longitudinal direction between an array of pick up locations and an array of drop off locations for the produce.

16. The robot according to claim 15, wherein at least one of:

the array of drop off locations are located on trays or boxes, or punnets, or bags, a number of the plurality of heads is less than a number of the array of pick up locations for the produce, the number of the plurality of heads is less than the number of the array of drop off locations for the produce, and the number of the array of pick up locations is greater than the number of the array of drop off locations.

17. The robot according to claim 1, a width of the rectangular envelope is approximately 50 to 80 mm wide.

18. A method of packing produce utilizing a robot, the method comprising:

(a) picking up at least one item of produce with at least one of a plurality of heads connected to a longitudinal carriage arm of the robot; and (b) dropping off the item of produce, the robot comprising:

a plurality of longitudinal carriage arms arranged in an array, each longitudinal carriage arm independently movable between an extended condition and retracted condition in a longitudinal direction;

the plurality of heads, each head connected to the longitudinal carriage arm and independently movable in a vertical direction to pick up, hold and drop off the item of produce; and a fixed support unit for supporting the plurality of longitudinal carriage arms;

a controller configured to control a first independent movement of a first longitudinal carriage arm comprised in the plurality of longitudinal carriage arms in a lateral direction relative to a second independent movement of a second longitudinal carriage arm comprised in the plurality of longitudinal carriage arms in the lateral direction to prevent collision between at least one of:

a first head of the first longitudinal carriage arm and the second longitudinal carriage arm, and a second head of the second longitudinal carriage arm and the first longitudinal carriage arm;

wherein the head and longitudinal carriage arm lie within a generally rectangular envelope in plan view, the rectangular envelope is substantially as wide as the longitudinal carriage arm; and wherein each longitudinal carriage arm is cantilevered off the fixed support unit; and wherein each longitudinal carriage arm is independently movable in the lateral direction to adjust relative spacing between the plurality of heads such that the plurality of heads can move across lanes to pick or place the item of produce.

* * * * *